US009296531B2

(12) United States Patent
Luzbetak et al.

(10) Patent No.: US 9,296,531 B2
(45) Date of Patent: Mar. 29, 2016

(54) CONTAINER WITH SEALED CAP AND VENTING SYSTEM

(75) Inventors: Mark A. Luzbetak, Kildeer, IL (US); Timothy D. Killinger, Mount Horeb, WI (US); Ryan Bauer, Fox River Grove, IL (US); Brian H. Silver, Cary, IL (US)

(73) Assignee: Medela Holding AG, Baar (CH)

( * ) Notice: Subject to any disclaimer, the term of this patent is extended or adjusted under 35 U.S.C. 154(b) by 951 days.

(21) Appl. No.: 12/983,093

(22) Filed: Dec. 31, 2010

(65) Prior Publication Data

US 2011/0168292 A1 Jul. 14, 2011

Related U.S. Application Data

(60) Provisional application No. 61/294,377, filed on Jan. 12, 2010.

(51) Int. Cl.

| | |
|---|---|
| ***A61J 9/00*** | (2006.01) |
| ***B65D 51/16*** | (2006.01) |
| ***B65D 47/08*** | (2006.01) |
| ***B65D 47/14*** | (2006.01) |
| ***B65D 47/24*** | (2006.01) |
| *A61J 1/20* | (2006.01) |
| *A61J 7/00* | (2006.01) |

(52) U.S. Cl.

CPC ..... *B65D 51/1644* (2013.01); *A61J 9/00* (2013.01); *B65D 47/0804* (2013.01); *B65D 47/14* (2013.01); *B65D 47/243* (2013.01); *B65D 47/248* (2013.01); *B65D 51/1611* (2013.01); *A61J 1/2075* (2015.05); *A61J 1/2096* (2013.01); *A61J 7/0046* (2013.01); *A61J 7/0053* (2013.01)

(58) Field of Classification Search

CPC . B65D 51/16; B65D 51/1633; B65D 51/1644
USPC ..... 141/2; 220/203.01–203.03, 203.11, 220/240, 254.1
See application file for complete search history.

(56) References Cited

U.S. PATENT DOCUMENTS

| | | | | |
|---|---|---|---|---|
| 2,321,236 | A | | 6/1943 | Parkin |
| 3,578,037 | A | | 5/1971 | Flynn |
| 3,853,157 | A | | 12/1974 | Madaio |
| 4,046,145 | A | | 9/1977 | Choksi et al. |
| 4,230,112 | A | | 10/1980 | Smith |
| 4,303,071 | A | | 12/1981 | Smith |
| 4,317,448 | A | | 3/1982 | Smith |
| 4,493,348 | A | | 1/1985 | Lemmons |
| 4,533,068 | A | * | 8/1985 | Meierhoefer ..... 222/189.09 |
| 4,588,403 | A | | 5/1986 | Weiss et al. |
| 4,623,343 | A | | 11/1986 | Thompson |
| 4,730,744 | A | | 3/1988 | Vinciguerra |

(Continued)

OTHER PUBLICATIONS

International Search Report and Written Opinion, Mar. 17, 2011.

(Continued)

*Primary Examiner* — Nicolas A Arnett
(74) *Attorney, Agent, or Firm* — McDonnell Boehnen Hulbert & Berghoff LLP

(57) ABSTRACT

A bulk feed adapter cap for a collection container comprises: (a) a housing defining both at least one fluid-communication opening and one or more air-release openings and (b) a membrane defining an annular, self-sealing fluid-valve for sealing said fluid-communication opening, where the fluid-valve defines at least one aperture. The bulk feed adapter cap may further comprise at least one fluid-communication cap.

51 Claims, 11 Drawing Sheets

(56) References Cited

U.S. PATENT DOCUMENTS

| | | | | |
|---|---|---|---|---|
| 4,834,152 | A | 5/1989 | Howson et al. | |
| 4,842,165 | A | 6/1989 | Van Coney | |
| 5,104,008 | A | 4/1992 | Crisci | |
| 5,279,576 | A | 1/1994 | Loo et al. | |
| 5,423,791 | A | 6/1995 | Bartlett | |
| 5,425,465 | A | 6/1995 | Healy | |
| 5,429,256 | A | 7/1995 | Kestenbaum | |
| 5,433,330 | A | 7/1995 | Yatsko et al. | |
| 5,433,353 | A | 7/1995 | Flinn | |
| 5,465,876 | A | 11/1995 | Crisci | |
| 5,556,008 | A * | 9/1996 | Silver et al. | 222/192 |
| 5,573,525 | A | 11/1996 | Watson et al. | |
| 5,598,939 | A | 2/1997 | Watson et al. | |
| 5,620,434 | A | 4/1997 | Brony | |
| 5,685,845 | A | 11/1997 | Grimard | |
| 5,839,626 | A * | 11/1998 | Gross et al. | 222/494 |
| 5,871,110 | A | 2/1999 | Grimard et al. | |
| 5,921,419 | A | 7/1999 | Niedospial, Jr. et al. | |
| 5,924,584 | A | 7/1999 | Hellstrom et al. | |
| 5,971,181 | A | 10/1999 | Niedospial, Jr. et al. | |
| 6,056,135 | A | 5/2000 | Widman | |
| 6,168,037 | B1 | 1/2001 | Grimard | |
| 6,206,230 | B1 | 3/2001 | Wan et al. | |
| 6,375,028 | B1 | 4/2002 | Smith | |
| 6,544,246 | B1 | 4/2003 | Niedospial, Jr. | |
| 6,601,720 | B2 * | 8/2003 | Meyers et al. | 215/11.5 |
| 6,612,344 | B2 | 9/2003 | Nagel et al. | |
| 6,666,852 | B2 | 12/2003 | Niedospial, Jr. | |
| 6,669,062 | B1 | 12/2003 | Laible | |
| 6,695,829 | B2 | 2/2004 | Hellstrom et al. | |
| 6,752,965 | B2 | 6/2004 | Levy | |
| 7,077,176 | B2 | 7/2006 | Py | |
| 7,150,370 | B2 | 12/2006 | Pyun | |
| 7,302,971 | B2 * | 12/2007 | Myntti | 137/852 |
| 7,799,009 | B2 * | 9/2010 | Niedospial et al. | 604/411 |
| 8,016,142 | B2 * | 9/2011 | Renz | 215/11.5 |
| 8,171,963 | B2 * | 5/2012 | Sonnier | 141/27 |
| 8,459,312 | B2 * | 6/2013 | Manera et al. | 141/27 |
| 8,567,619 | B2 * | 10/2013 | Renz | 215/11.5 |
| 8,603,557 | B2 * | 12/2013 | de Cleir et al. | 426/115 |
| 2003/0106910 | A1 * | 6/2003 | Hicks et al. | 222/494 |
| 2004/0149349 | A1 | 8/2004 | D'Antonio et al. | |
| 2006/0025747 | A1 | 2/2006 | Sullivan et al. | |
| 2007/0029352 | A1 * | 2/2007 | Norris et al. | 222/494 |
| 2007/0051727 | A1 | 3/2007 | Holley, Jr. | |
| 2007/0076401 | A1 | 4/2007 | Carrez et al. | |
| 2007/0078429 | A1 | 4/2007 | Sharp | |
| 2007/0269251 | A1 | 11/2007 | Skalitzky et al. | |
| 2007/0284332 | A1 | 12/2007 | Gowans et al. | |
| 2008/0015539 | A1 | 1/2008 | Pieroni et al. | |
| 2008/0038045 | A1 | 2/2008 | Hofte et al. | |
| 2008/0214998 | A1 | 9/2008 | Kurek et al. | |
| 2008/0283143 | A1 | 11/2008 | McKibbin et al. | |
| 2009/0139882 | A1 * | 6/2009 | DeJonge | 206/219 |
| 2009/0163859 | A1 | 6/2009 | Lloyd et al. | |
| 2009/0194548 | A1 | 8/2009 | Naesje | |
| 2012/0241043 | A1 * | 9/2012 | Perazzo et al. | 141/2 |

OTHER PUBLICATIONS

Supplementary European Search Report, Mailed Apr. 30, 2015, Based on Application No. EP 11733235.3, filed Jan. 10, 2011.

* cited by examiner 10
15
20
45
50
70
72
74
75
76
80
163
190
192

CONTAINER WITH SEALED CAP AND VENTING SYSTEM

This application claims priority to provisional application U.S. Ser. No. 61/294,377, filed Jan. 12, 2010.

BACKGROUND OF THE INVENTION

In the Neonatal Intensive Care Unit (NICU), breastmilk is refrigerated in standard breastmilk collection containers. Typically these containers have a volume of 80, 150, or 250 milliliters. The containers are commonly filled with enough breastmilk to feed an infant over a period of 24 to 48 hours. Breastmilk fortifiers are also added to this "bulk feed" as prescribed for the infant and mixed into the breastmilk. An amount of fortified breastmilk normally between 20 ml and 60 ml is then dispensed from this bulk feed for an individual feeding every 2-4 hours. Feedings in the NICU are commonly performed enterally. Enteral feeding of the neonate generally requires that the breastmilk be drawn into a syringe (e.g., an oral slip-fit or luer-type fit) from the collection container containing the fortified breastmilk. This syringe is subsequently used with either a gravity system or enteral feeding pump to feed an infant.

Nurses typically require two hands on the syringe to extract milk from an open collection container. With two hands on the syringe, a nurse has no hand available to stabilize the container of milk being drawn from. This can result in spilling of milk or other accidents. Mothers of premature infants often do not produce an overabundance of breastmilk, so it is desired to provide the neonate with all available milk.

In addition, prior to milk withdrawal, the exterior surface of the syringe may potentially come into contact with an unclean surface, perhaps bearing pathogens. This can result in contamination of the breastmilk supply when the syringe is then dipped into the collection container for milk withdrawal.

SUMMARY OF THE INVENTION

In accordance with significant objectives of the invention, a novel feed adapter cap claimed herein minimizes the risk of contamination to the contents of the collection container, and likewise lowers the risk that the contents will be spilled or not fully dispensed.

Thus, in a first aspect, a feed adapter cap for a collection container comprises: (a) a housing defining both a fluid-communication opening and one or more air-release openings and (b) a membrane defining an annular, self-sealing fluid-valve for sealing the fluid-communication opening, wherein the fluid-valve defines at least one aperture.

The foregoing membrane may include, for instance, a plug element which is received within and closes the fluid-communication opening. The tip of a syringe, luer or the like, is then used to push the plug and membrane to a position which then opens the aperture for fluid flow out.

In a second aspect, a bulk feed adapter cap for a collection container comprises: (a) a housing defining at least one fluid-communication opening, (b) one or more air-release openings, and (c) at least one fluid-communication cap.

For example, an adapter cap for removal of fluid from a container of the invention has a housing defining at least one fluid-communication opening. A member is movably mounted within the housing to close the fluid-communication opening in a first position under force from a biasing element, which may be a portion of the member itself, and movable away from the fluid communication opening under influence of a force applied axially against the member (as by a syringe or luer tip), and against a bias of said biasing element. A fluid channel is further formed in one or both of the housing and the member, with the fluid channel communicating between the fluid-communication opening and the interior of the container, and being opened to fluid flow in a second position.

The member may be a membrane, with part of the membrane forming a plug to close the fluid-communication opening. It may further have a second plug portion which is surrounded by a second plug annulus. This second annulus provides a spring-like region permitting movement of the second plug portion away from the airflow opening under influence of a pressure change in the container interior, and back toward the airflow opening when the pressure has equalized.

In another aspect, the invention has an adapter cap for a collection container comprising (a) a housing defining a fluid communication opening, and (b) a membrane defining an air release opening, where the membrane also functions as a seal closure for the fluid communication opening.

In one version, the seal closure for the fluid communication opening may be opened by inserting a luer type or oral fitting type syringe into the fluid communication opening.

In yet a further version, the seal closure, such as in the form of an extended plug-like element, is extended up to the top edge of the opening, so that it may be wiped clean prior to inserting of a syringe.

Still another aspect of the invention has the adapter cap for a collection container comprising (a) a housing defining a fluid communication opening, and (b) a membrane defining a seal between the housing and the collection container, where the membrane also defines an air release opening (vent) and (c) at least one fluid communication cap.

The invention also contemplates an adapter cap for a collection container comprising (a) a housing defining a fluid communication opening, and (b) a membrane defining a seal between the housing and the collection container, where the membrane also defines an air release opening (vent) and a seal closure for the fluid communication opening.

An additional advantageous feature for the invention includes a tube connected to a point above the air release opening, with the tube extending into the container to a desired point with the end of the tube away from the fluid delivery outlet (such as to a point near the bottom of the container (bottle)). Air entering the container in response to fluid flow out will thus tend to be much less entrained in the outflow, or even eliminated from mixing with the fluid.

The invention also contemplates a method of using the adapter cap, comprising mounting a bulk feed adapter cap on a collection container, and then inserting a needleless syringe into a fluid-communication opening. This action axially displaces a fluid-valve. The collection container is inverted, with the user then drawing on a plunger of the needleless syringe. Equalization of the internal pressure of the collection container occurs in the course of removing fluid. Returning the collection container to an upright position, the fluid-valve reseals the fluid-communication opening.

The present invention will be further appreciated, and its attributes and advantages further understood, with reference to the detailed description below of examples of presently contemplated embodiments, taken in conjunction with the accompanying drawings, in which:

DETAILED DESCRIPTION OF EMBODIMENTS OF THE INVENTION

Figures 1A, 1B, 1C, 1D, 1H, 1I:
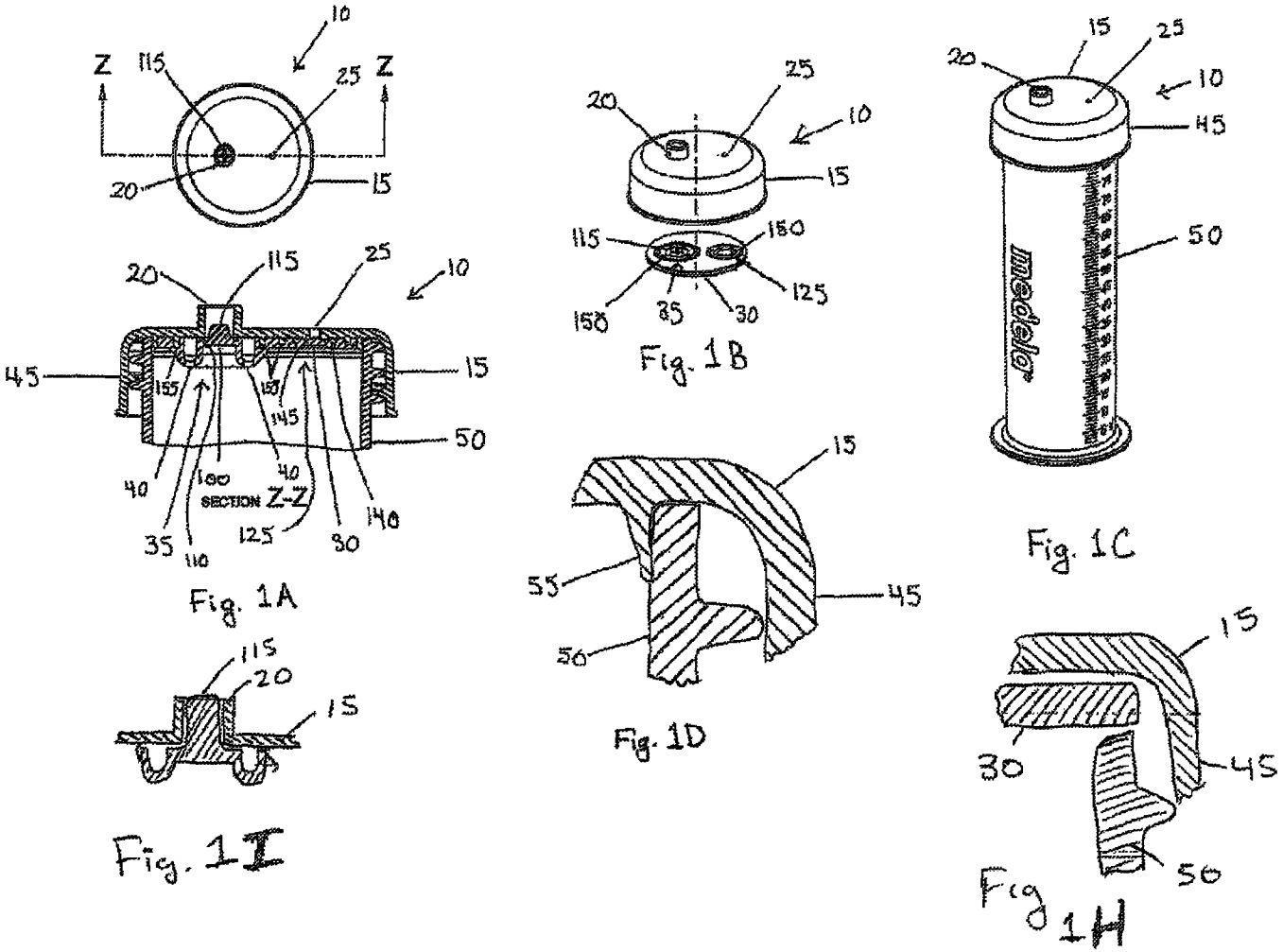
FIG 1A is an elevational cross-sectional view of an embodiment of a feed adapter cap made in accordance with the invention, in position on a container.
FIG. 1B is an exploded perspective view of the cap of FIG. 1A showing a housing and membrane.
FIG. 1C is a perspective view of the feed adapter cap on the collection container shown in FIG. 1A.
FIG. 1D is an enlarged cross-sectional view of part of the housing's lip and the collection container shown in FIG. 1A.
FIG. 1H is a view similar to that of FIG. 1D, but of a variant having the membrane serving as a gasket.
FIG. 1I is an enlarged view of the fluid-communication opening of FIG. 1A, but with a modified raised member extending to the edge of the opening.
Figure 1G:
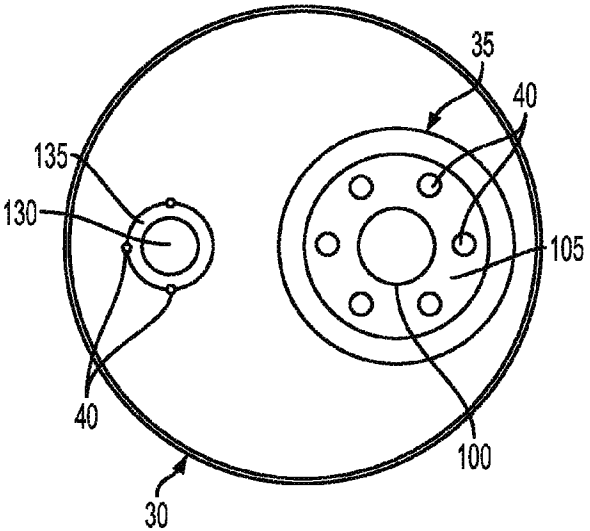
FIG. 1G is a bottom view of the membrane of FIG. 1E.
Figure 1F:
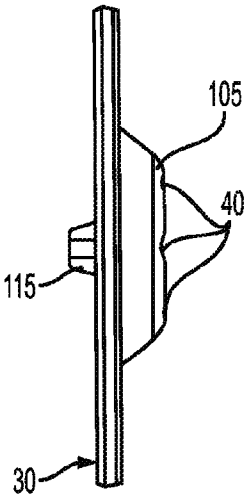
FIG. 1F is a side view of the membrane of FIG. 1E.
Figure 1E:
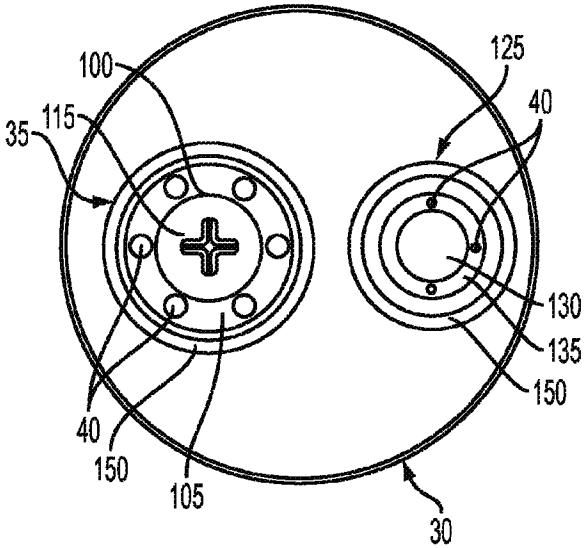
FIG. 1E is a top view of the membrane shown in FIG. 1B.
Figure 2B:
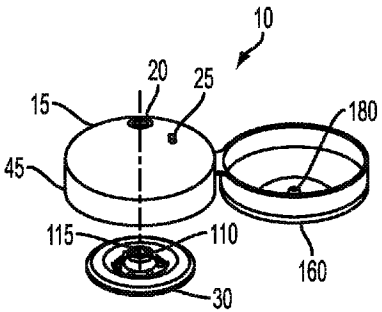
FIG. 2B is an exploded perspective view of the cap of FIG. 2A showing a housing and membrane.
Figure 2C:
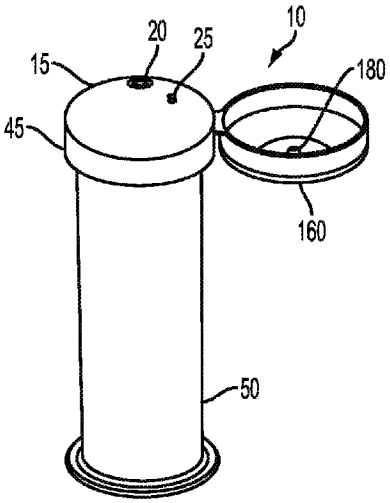
FIG. 2C is a perspective view of the feed adapter cap on the collection container as shown in FIG. 2A.
Figure 2A:
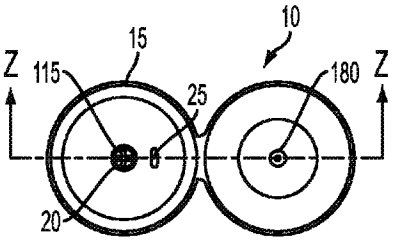
FIG. 2A is an elevational cross-sectional view of another embodiment of a feed adapter cap made in accordance with the invention, in position on a container.
Figure 2A:
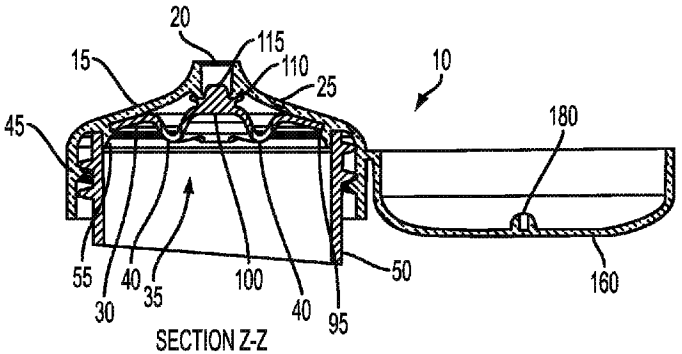
Figure 2F:
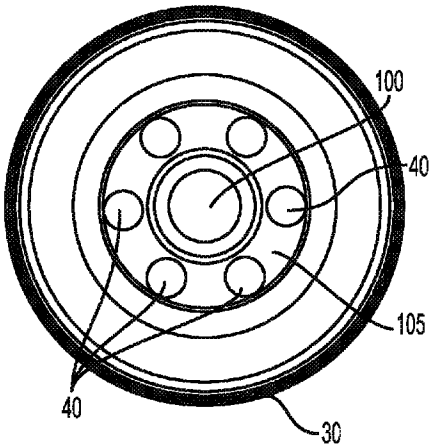
FIG. 2F is a bottom view of the membrane of FIG. 2D.
Figure 2E:
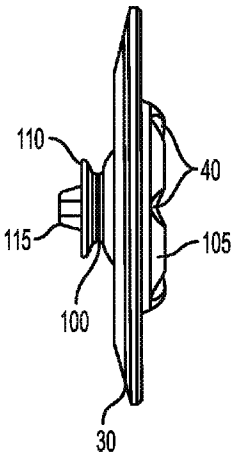
FIG. 2E is a side view of the membrane of FIG. 2D.
Figure 2D:
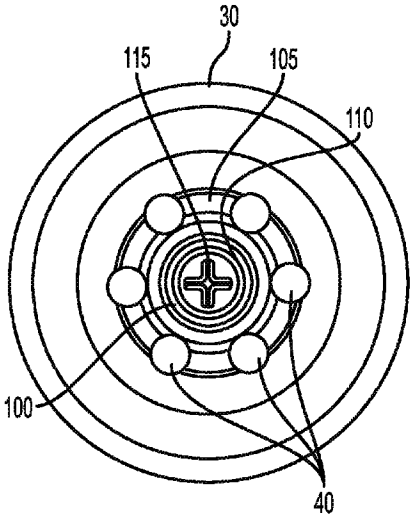
FIG. 2D is a top view of the membrane of FIG. 2B.

In a first aspect, as shown in FIGS. 1A and 2A, a feed adapter cap 10 for a collection container 50 comprises: (a) a housing 15 defining both a fluid-communication opening 20 and one or more air-release openings or vents 25; and (b) a membrane 30 defining an annular, self-sealing fluid-valve 35 therein for sealing the fluid-communication opening 20. The fluid-valve 35 defines at least one aperture 40; here plural apertures 40 are provided. The cap 10 will often be referred to herein as a bulk adapter cap, in that material "in bulk" carried by the container is to be transferred to another container (such as a syringe).

The housing 15 has an internally threaded collar 45 that is adapted to be received by a collection container 50 with mating threads, and has a top surface that defines the fluid-communication opening 20 and one (or more) air-release openings 25. The collection container 50 refers to a container that houses fluids, such as breastmilk. When the housing 15 is affixed to a collection container 50 with a 6 in-lb torque, the housing 15 will maintain a leak-proof seal. This leak-proof seal will continue even when the container 50 is inverted and has an internal pressure of 5 psi, which approximates a "worst case" scenario if a nurse overdraws the breastmilk and re-injects 10 ml of milk. The cap 10 can be attached to the container 50 opening or mouth, through other means, such as a snap-fit, just for one other example.

In this embodiment, shown in FIG. 1D, the housing 15 may further define an internal flexible annular lip 55, tapered for an interference fit with the internal wall of the collection container 50 near the mouth, such that the collection container 50 is sandwiched between the collar 45 and annular lip 55. The housing 15 may be made of many materials, for example, plastic or metal, and is preferably made of polypropylene or other food-compatible plastic.

The fluid-communication opening 20 is adapted to receive an oral-tip, luer, or any other needleless syringe 60 (see, e.g., FIGS. 9A and 9B) to transfer the contents of the collection container 50 to the syringe 60 or vice versa. "Needleless" simply implies a widened opening to the syringe for delivery of liquids externally (as opposed to subcutaneous use). Also, like numbers indicate like elements throughout the drawings; primed numbers indicate a like element that has been modified to some extent.

In one embodiment, displayed in FIGS. 2A-F, the fluid-communication opening 20 is substantially centered in the housing 15, and the air-release opening 25 is off-center in the housing 15. Alternatively, FIGS. 1A-G show that both the fluid-communication opening 20 and the air-release opening 25 are off-center in the housing 15. The purpose of off-setting the air-release opening 25 from the fluid-communication opening 20 is to prevent air bubbles that are entering the collection container 50 from being caught in the fluid-draw into the syringe 60, for instance (e.g., FIG. 4A).

The fluid-communication opening 20 protrudes from the housing 15 (see e.g., FIGS. 1A-1C and 2A-2C). In some embodiments, the fluid-communication opening 20 is substantially funnel-shaped, as shown in FIGS. 2, 4, 5, 7, and 8. As used herein, the funnel-shape may be shallow (FIGS.

2A-C), or elongated (FIGS. 5A, 7A), or taper at different slopes leading to the fluid-communication opening 20 (FIGS. 4A-C, 8).

The air-release opening 25 allows air to enter and exit a collection container 50 to maintain the internal pressure of the container 50. The one or more air-release openings 25 are shown as a circular hole (FIGS. 1A-D, 5A, 5C, 7A-B) or kidney-shape (FIGS. 2A-C). The air release opening(s) may take any form as long as they are large enough to allow air to pass through to relieve pressure build-up during breastmilk transfer. In one embodiment, as shown in FIGS. 2A-C, the bulk feed adapter cap 10 further comprises a microhole covering that seals the air-release opening 25. The microhole covering is a semi-permeable membrane that allows air to enter or exit but does not permit the passage of fluids.

Figure 3B:
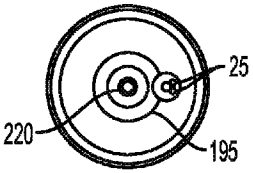
FIG. 3B is a top view of the feed adapter cap with a fluid-communication-pull cap of FIG. 3A.
Figure 3C:
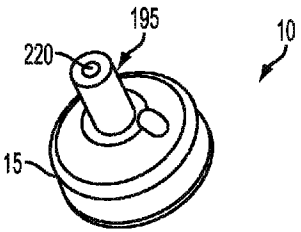
FIG. 3C is a perspective view of the feed adapter cap with a fluid-communication-pull cap of FIG. 3A.
Figure 3A:
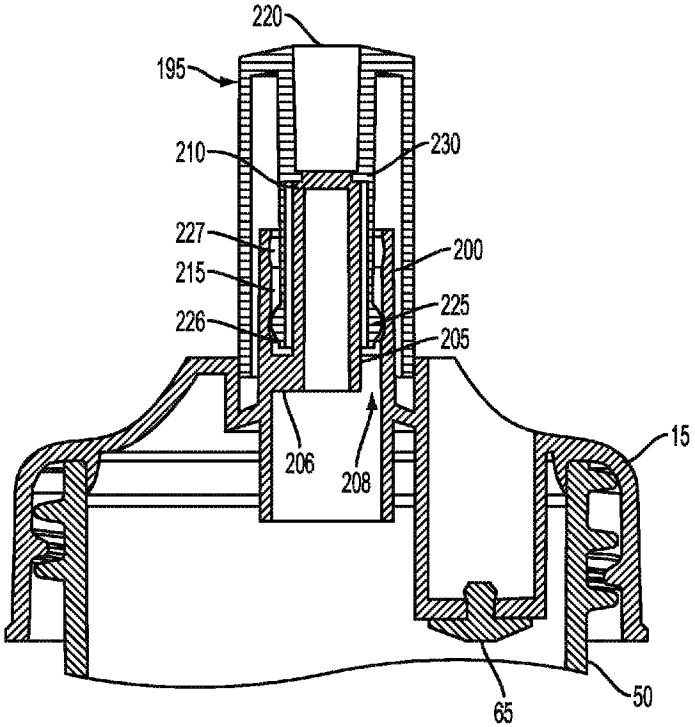
FIG. 3A is an elevational cross-sectional view of yet another embodiment of the feed adapter cap with a fluid-communication-pull cap made in accordance with the invention, in position on a container.
Figure 4A:
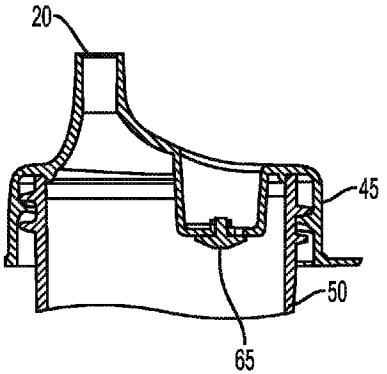
FIG. 4A is an elevational cross-sectional view of still another embodiment of a feed adapter cap with one or more recessed air-release openings and an umbrella valve seal made in accordance with the invention, in position on a container.
Figure 4B:
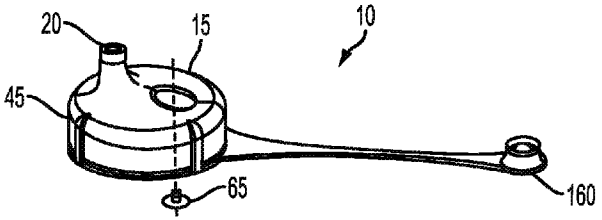
FIG. 4B is a perspective view of the feed adapter cap of FIG. 4A, with an umbrella valve seal removed.
Figure 4C:
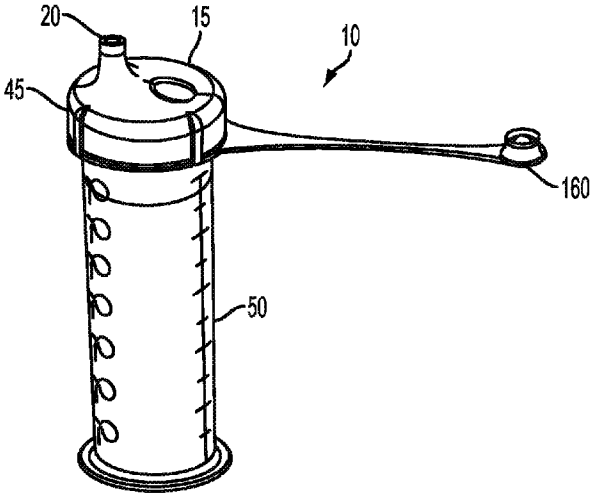
FIG. 4C is a perspective view of the collection container and feed adapter cap thereon of FIG. 4A.

In another embodiment, the one or more air-release openings 25 are recessed within the housing 15 (FIGS. 3A, 4A, 5A, 5C, 7A). By recessing the air-release openings 25 the likelihood is reduced that air bubbles will be caught in the fluid-draw into the syringe 60. In yet another embodiment, the air-release openings 25 are sealed via an umbrella valve seal 65. Such umbrella valves are common, such as shown in U.S. Pat. No. 7,302,971. As shown in FIGS. 3A and 4A, the umbrella valve seal 65 is located on the interior of the housing 15. When the interior of the collection container 50 is not under a reduced or negative pressure (relative to ambient pressure), the umbrella valve seal 65 is closed, due to its natural bias. Once material is withdrawn from the collection container 50, the umbrella valve 65 opens (unseats) to allow air to pass into the container 50. Thus, during fluid transfer to a syringe 60, the umbrella valve 65 is subsequently drawn open due to a change in internal pressure in the collection container 50. Other valve types may be used in place of an umbrella valve, for example a slit valve may be used.

In still another embodiment, illustrated in FIGS. 5A-D, instead of an umbrella valve, the one or more air-release openings 25 are surrounded by a long tube 70 that has a length that terminates near the bottom of the collection container 50. Inside of a widened part 80 of the long tube 70 at the top thereof is a second short tube 72. Short tube 72 opens into a shallow well 74 formed into the cap 10, at short tube 72 opening 76. An annular gap 75 (see FIG. 5C) exists between the tube 70 and the tube 72 forming a chamber in order to capture fluid that collects in the tube 70 when the collection container 50 is inverted. When the container 50 is tipped, or completely inverted, the fluid in long tube 70 can flow into the gap or chamber 75, rather than spilling out (a small amount may pass through) short tube 72 in some circumstances. Air can now likewise pass through short tube opening 76 as fluid is withdrawn from the container 50, traveling via long tube 70 into the (now inverted) bottom of container 50. In this manner, air does not become entrained in the fluid being removed. The volume of this annular gap or chamber 75 may vary, so as to prevent fluid from leaking out of the air-release opening 76. When the collection container 50 is returned to the upright position, the fluid will drain back down the tube 70 and into the collection container 50. As shown in FIG. 5E, an alternate embodiment is to add a valve, for example, an umbrella valve 65', to the bottom of the tube 70. This valve prevents fluid from entering the tube at the bottom. Here, the tube is also shown connected directly to the housing 15 at the tube opening 76', which could be by an interference fit, welding or the like.

The membrane is a flexible member made of a polymeric blend, silicone or rubber, for example. The membrane 30 is capable of being axially displaced, then returning to its original position due to its spring-like properties. The membrane 30 may be attached to the housing 15 using any conventional means, such as a press-fit. As shown in FIGS. 1A and 2A, the housing's annular lip 55 defines an annular-detent ring 95 (which could also be a plurality of individual detents) to allow the membrane 30 to snap-fit into the housing 15. The housing 15 and membrane 30 may define other male and female components on their mating surfaces for coupling the membrane 30 to the housing 15, as discussed below. The membrane 30 could also be captured between the housing interior and the container mouth opening, thereby also serving as a sealing gasket (see FIG. 1H). In embodiments in which the air-release opening 25 is recessed, the membrane 30 may define an additional opening sized to accommodate the recess but small enough to provide a fluid-tight seal.

Figure 9B:
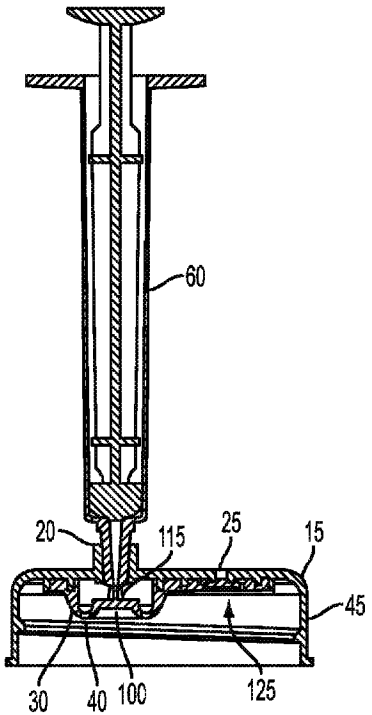
FIG. 9B is an elevational cross-sectional view of a syringe inserted into the feed adapter cap of FIG. 1A.
Figure 9A:
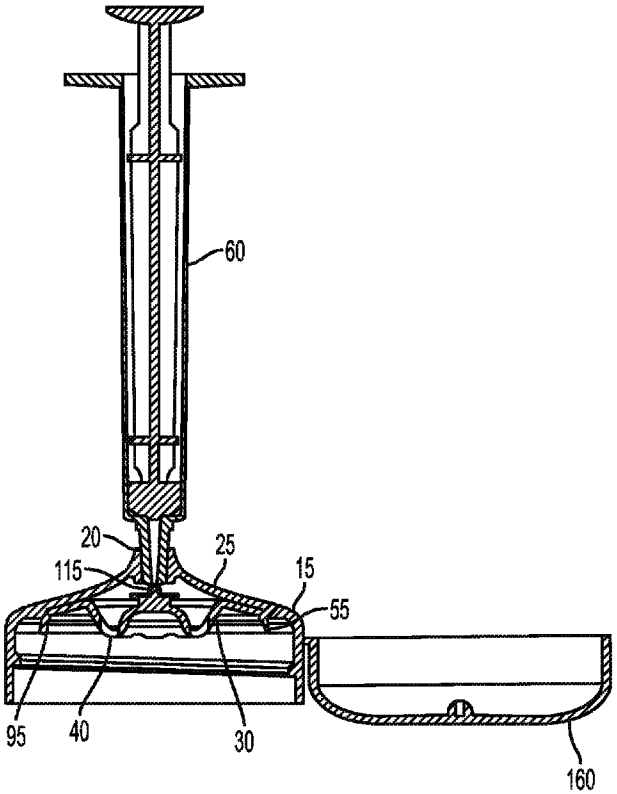
FIG. 9A is an elevational cross-sectional view of a syringe inserted into the feed adapter cap of FIG. 2A.

Referring back to FIGS. 1A and 1B, an annular, self-sealing fluid-valve 35 comprises a plug 100 and an annulus 105 (see FIGS. 1E-1G) that is convex relative to the housing 15. The fluid-valve 35 further defines at least one aperture 40 (here, a plurality of apertures 40) to allow fluid communication between the collection container 50 and a syringe 60 when the fluid-valve 35 is axially displaced (as shown in FIGS. 9A-B). The flexible annular portion 105 of the fluid-valve 35 has spring-like properties that allow the fluid-valve 35 to be axially displaced by a syringe 60 and then rebound back to the original sealed position (shown in FIGS. 1A, 2A) upon removal of the syringe, forcing the plug 100 against the fluid-communication opening 20. The plug 100 may contain an annular channel 110 (FIGS. 1A, 2A-B, D) or shoulder to mate with the fluid-communication opening 20. In one embodiment, displayed in FIGS. 2A-B, D-E, the annular, self-sealing fluid-valve 35 defines at least one raised member 115 on the depressed core 100. The raised member 115 may take the form of one or more ribs or nubs, for example, and functions like a plug, at least in the area of the base thereof. The principal purpose of the raised member 115 at its top, however, is to contact the end of the syringe 60 to effect the displacement of the valve 35 as well as to prevent the depressed core 100 from blocking the entire syringe-inlet and to strengthen the plug. In one preferred embodiment, the plug 115 is elongated such that it is flush or proud to opening 20 (see FIG. 1I). The end of the raised member 115 may then be swabbable with an antiseptic cloth prior to insertion of the syringe to maintain a clean fluid path.

In one embodiment, in FIGS. 1A-1G, the membrane 30 further defines an annular, self-sealing air-valve 125. Annular, self-sealing air-valve 125 comprises a plug 130 and an annulus 135 that is convex relative to the housing 15. The air-valve 125 further defines at least one aperture 140 (here, a plurality of apertures 40) to allow air to flow between the collection container 50 and the atmosphere to equalize pressure. The flexible annulus 135 of the air-valve 125 has spring-like properties that allow the air-valve 125 to be axially displaced (not shown) by a build-up of internal pressure in the collection container 50 and then rebound back to the original sealed position (shown in FIG. 1A) upon pressure equalization. The annulus 135 forces the plug 130 against the housing's air-release opening 25. In addition, the plug 130 may contain an annular channel 145 (FIG. 1A) or a shoulder to mate with the air-release opening 25.

Figures 5A, 5B, 5C, 5D, 5E:
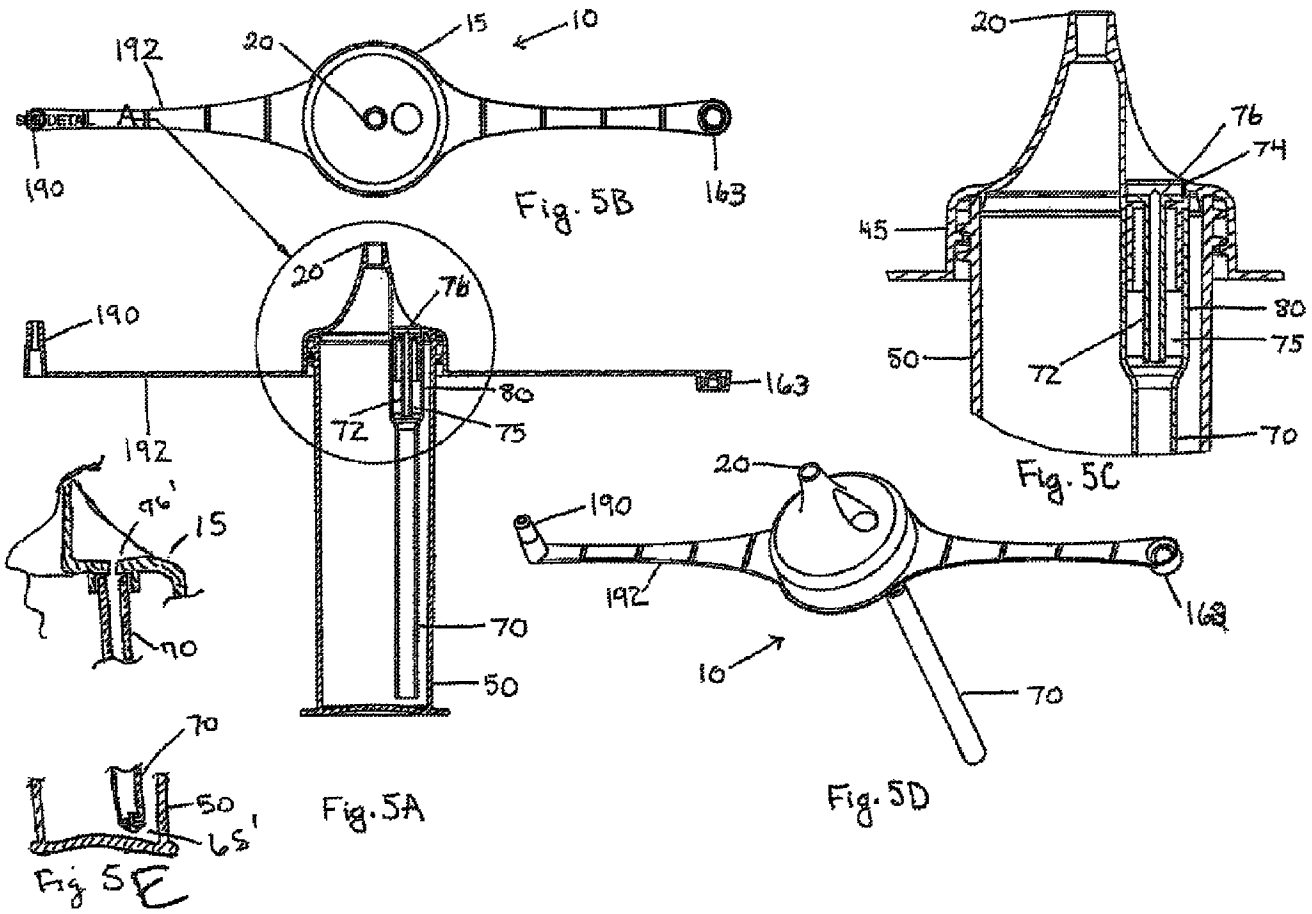
FIG. 5A is an elevational cross-sectional view of still another embodiment of a collection container and the feed adapter cap with a tube, made in accordance with the invention.
FIG. 5B is a top view of the feed adapter cap of FIG. 5A.
FIG. 5C is an enlarged cross-sectional view of the feed adapter cap on the container of FIG. 5A.
FIG. 5D is a perspective view of the feed adapter cap and tube of FIG. 5A.
FIG. 5E is a similar view, although only of a part, to that of FIG. 5A, showing a variant on the tube arrangement therein.

As shown in FIGS. 1A-B, the self-sealing fluid- and air-valves 35, 125 are each circumscribed by an annular-female channel 150 for receiving a male detent ring 155 on the underside of the housing 15. Affixing the membrane 30 to the housing 15 in this manner allows the fluid-valve 35 to be axially displaced by a syringe 60 without prematurely displacing the air-valve 125. Alternatively, the housing 15 may define the continuous female channel 150, while the membrane 30 defines the male detent ring 155. In addition, the membrane 30 and housing 15 may define many other arrangements of male/female components on their mating surfaces to affix the membrane 30 to the housing 15. For example, the continuous female channel 150 and male detent 155 may take any shape, including a square, hexagon, or triangle. Other female/male connectors may be discrete and not continuous. These female/male connectors on the housing 15 and membrane 30 allow the membrane 30 to be sized to accommodate a recessed air-release opening 25 and/or tube 70 (FIGS. 5A-5C). Alternatively, the membrane's static mating surface may be affixed to the housing 15 with an adhesive.

In use, the feed adapter cap 10 is mounted to a collection container 50. Then the user inserts the syringe 60 into the fluid-communication opening 20, axially displacing the fluid-valve 35. The user then inverts the collection container 50 and draws on the syringe plunger, applying a suction to the contents of the collection container 50. As a result, the air-valve 125 opens during the fluid transfer as the internal pressure of the collection container 50 increases. After the syringe 60 has been filled and subsequently removed, the fluid-valve 35 returns to the closed, sealed position.

In a second aspect, the bulk feed adapter cap 10 for a collection container 50 comprises: (a) a housing 15 defining at least one fluid-communication opening 20, (b) one or more air-release openings 25, and (c) at least one fluid-communication cap 160 (see FIGS. 2A-2C and 9A).

Figure 6A:
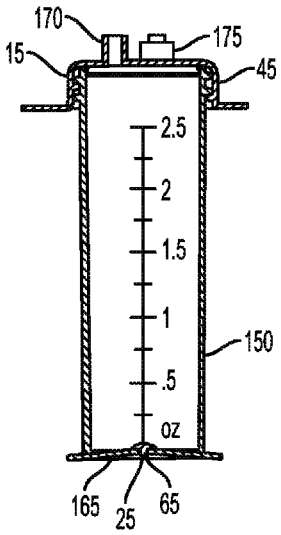
FIG. 6A is a cross-sectional view of another embodiment of a collection container and feed adapter cap with a plurality of fluid-communication openings, made in accordance with the invention.

In one embodiment, at least one fluid-communication opening 20 is substantially centered in the housing 15, and the air-release opening 25 is off-center in the housing 15. Alternatively, all the fluid-communication openings 20 and the air-release opening 25 are off-center in the housing 15 (FIGS. 6A-C).

In another embodiment, the bulk feed adapter cap 10 further comprises a collection container 50. In this embodiment, the base 165 of the collection container 50 (see FIG. 6A) contains one or more air-release openings 25, which are sealed via an umbrella valve seal 65, shown in FIG. 6A. When the collection container 50 is upright, gravity and the contents of the container close the umbrella valve seal 65. As the container 50 is inverted, the umbrella valve seal 65 opens due to gravity and a change in internal pressure.

Figure 6B:
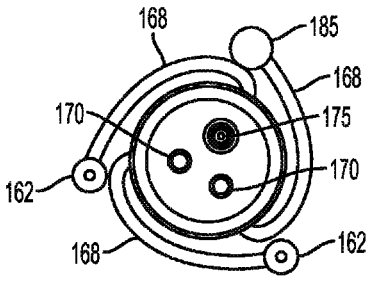
FIG. 6B is a top view of the feed adapter cap of FIG. 6A.
Figure 6C:
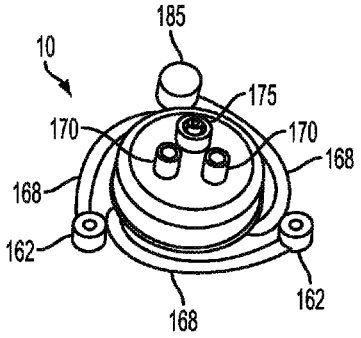
FIG. 6C is a perspective view of the feed adapter cap of FIG. 6A.
Figure 7A:
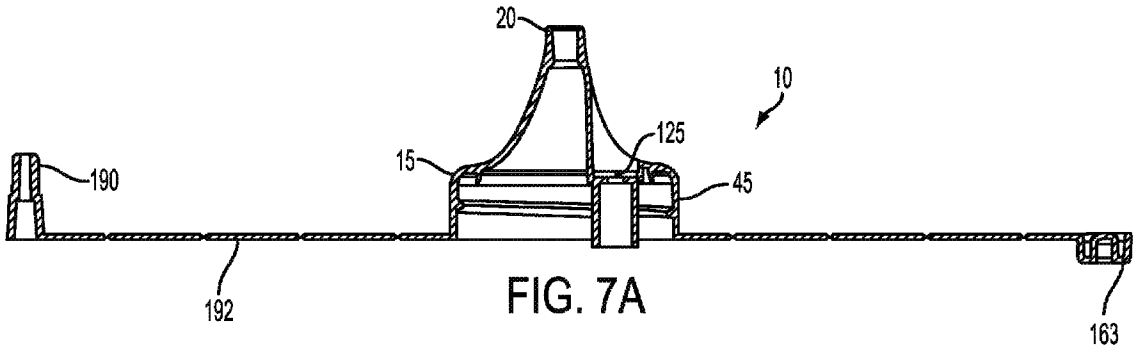
FIG. 7A is an elevational cross-sectional view of a further embodiment of a feed adapter cap with a sizing cap and fluid-communication cap tethered to the housing, made in accordance with the invention.
Figure 7B:
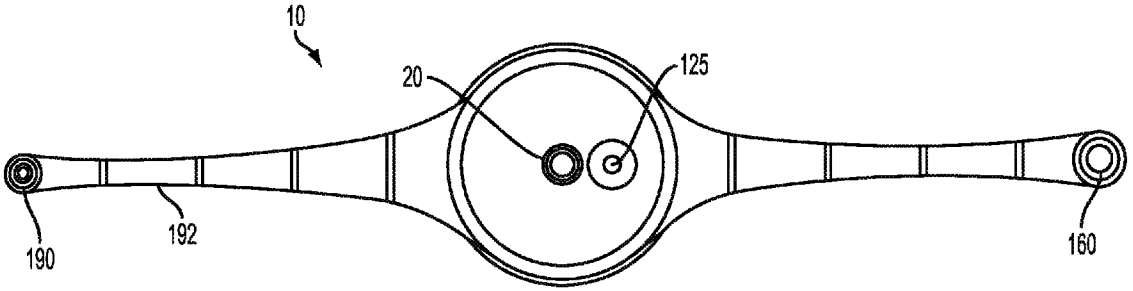
FIG. 7B is a top view of the feed adapter cap of FIG. 7A.
Figure 7C:
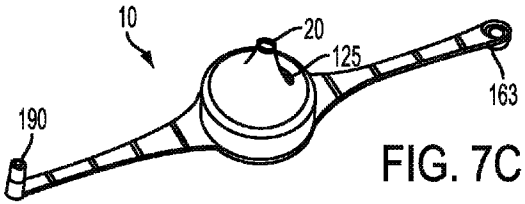
FIG. 7C is a reduced perspective view of the feed adapter cap of FIG. 7A.
Figure 8:
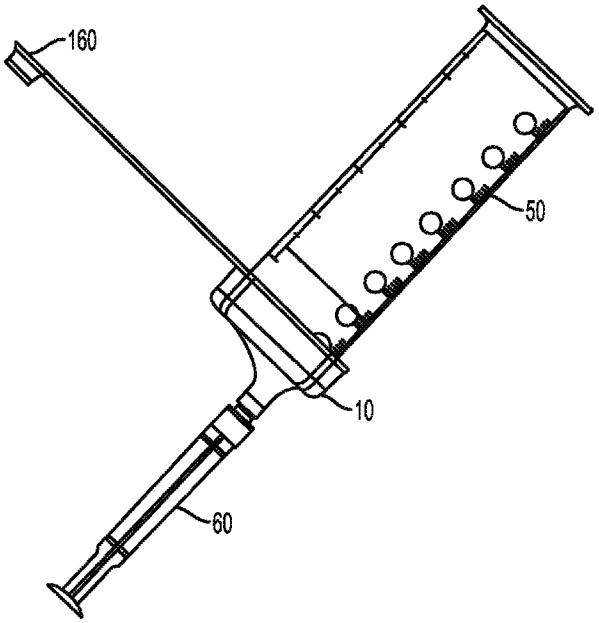
FIG. 8 is a side view of a syringe inserted into the feed adapter cap of FIG. 4A.

As illustrated in FIGS. 6B-C, in another embodiment, the housing 15 defines a plurality of fluid-communication openings, where at least one fluid-communication opening 170 is adapted to receive an oral syringe and at least one fluid-communication opening 175 is adapted to receive a luer syringe. The plurality of fluid-communication openings 20 may alternatively be adapted to receive any combination of needleless syringes 60.

In this embodiment, at least one fluid-communication cap 162 is tethered to the housing 15 via tethers 168. FIGS. 5A-D and 7A, 7B show an example of another fluid-communication cap 163. Likewise, FIGS. 6B-C illustrate multiple caps, each of which can be adapted to fit different fluid-communication openings 170, 175. For example, FIG. 6B shows two oral-tip-type fluid-communication caps 162 and one luer-type cap 185. In an alternative embodiment, at least one fluid-communication cap 160 is attached to the housing 15 via a living hinge (FIGS. 2A-2C) and the cap 160 defines a nub or plug 180. Each fluid-communication cap 160 may engage the perimeter of the housing 15, as shown in FIGS. 2A-C, or may engage only the individual fluid-communication openings 20, as shown in FIGS. 6B-C.

In a further embodiment, displayed in FIGS. 5A-D, the bulk feed adapter cap 10 may further comprise a sizing cap 190 tethered via arm 192 to the housing 15. The sizing cap 190 may be inserted into the fluid-communication opening 20 to accommodate a smaller sized oral-tip syringe 60.

In use of the afore-described embodiment, the bulk feed adapter cap 10 is mounted to a collection container 50. Then the user removes a fluid-communication cap, such as cap 160, and inserts the needleless syringe 60 into the fluid-communication opening 20. The user then inverts the collection container 50 and draws on the syringe plunger, applying a vacuum pressure to the contents of the collection container 50. In response, the air-valve 125 opens during the fluid transfer as the internal pressure of the collection container 50 increases. When the syringe 60 is filled, the collection container 50 is placed in the upright position and the fluid-communication cap 160 is replaced on the fluid-communication opening 20.

In a third aspect of the invention, the bulk feed adapter cap 10 comprises: (a) a housing 15 defining at least one fluid-communication opening 20, (b) an air-release opening 25, and at least one fluid-communication-pull cap 195, shown in FIGS. 3A-C. The housing 15 defines a first protruding hollow cylinder 200. Disposed within the first hollow cylinder 200 is a second cylinder 205 that may be either solid or hollow, but is closed, with an annular shoulder 210 along its top surface. The second cylinder 205 is connected near its base at 206 to a portion of the first hollow cylinder 200. The unattached portion of the second cylinder 205 is spaced from the interior sidewall of cylinder 200, and thereby defines a fluid-communication channel 208. This arrangement also results in an annular gap 215 between the first and second cylinders 200, 205.

The pull cap 195 is preferably substantially cylindrical with a hollow interior. At one end, the pull cap 195 defines an opening 220 sized to receive a needleless syringe 60. The pull cap 195 further defines an annular detent 225 about the exterior of the other end that is disposed within the annular gap 215 between the first and second cylinders 200, 205 of the housing 15, thereby sealing the channel 208. This can be a friction fit, or the housing's first cylinder 200 may define two spaced-apart annular channels 226, 227 on its interior surface to interface with the pull cap's annular detent 225. The pull cap 195 also defines an annular shoulder 230 on its interior diameter, such that, when the pull-cap detent 225 is engaged with the first cylinder's lower annular channel 226, the pull-cap shoulder 230 interfaces with the second cylinder's shoulder 210, further creating a fluid-tight seal. When the pull-cap detent 225 is moved to engage the first cylinder's higher annular channel 227, the shoulders 210, 230 are spaced apart (not shown) and the fluid-communication channel 208 is unobstructed, and a syringe may be engaged with the outside of the cylinder 200 to remove fluid from the container 50. The user pulls the pull cap 195 to open and pushes the pull cap 195 to close the collection container 50.

Note that many aspects of the foregoing embodiments may be combined together to practice the claimed invention. Thus, while a multitude of embodiments have been variously described herein, those of skill in this art will recognize that different embodiments show different potential features/designs that can be used in the other embodiments. Even more variations, applications and modifications will still fall within the spirit and scope of the invention, all as intended to come within the ambit and reach of the following claims.

The invention claimed is:

1. A cap for a container comprising:

a cap housing defining a fluid-communication opening therein through which material in a container to which said cap housing is attached may be accessed;

a membrane mounted to said cap housing sealing said fluid-communication opening in a first position, said membrane being movable away from said fluid-communication opening in a second position, said membrane defines a solid plug which is received within and closes said fluid-communication opening in said first position and which is displaced from and opens said fluid communication opening in said second position, said membrane defines a plurality of apertures arranged about a perimeter of said plug.

2. The device of claim 1, wherein said membrane snap-fits into said cap housing.

3. The device of claim 1, wherein said plug has at least one raised member thereon in the form of a rib.

4. The device of claim 1, wherein said plug is surrounded by an annular channel formed in said membrane, said annular channel providing flexibility for movement of said plug toward and away from said fluid-communication opening.

5. The device of claim 1, wherein said membrane further defines a self-sealing one-way air-valve for airflow into the container through an airflow opening defined in said cap housing.

6. The device of claim 5, wherein said fluid-communication opening is substantially centered in said cap housing, and wherein said air-valve is off-center in said cap housing.

7. The device of claim 5, wherein said air-flow opening is sealed via an umbrella valve seal.

8. The device of claim 1, further including an airflow opening in said cap housing, said airflow opening communicating with a tube that has a length that terminates between the midpoint and bottom of said container.

9. The device of claim 1, wherein said fluid-communication opening protrudes from said cap housing.

10. The device of claim 9, wherein said fluid-communication opening is in part funnel-shaped.

11. The device of claim 9, wherein said fluid-communication opening is adapted to receive an oral syringe.

12. The device of claim 9, wherein said fluid-communication opening is adapted to receive a luer syringe.

13. A method using the cap of claim 1, comprising:

mounting a bulk feed adapter cap on a collection container;

inserting a needleless syringe into a fluid-communication opening, displacing a fluid-valve;

inverting the collection container;

drawing on a plunger of the needleless syringe;

equalizing the internal pressure of the collection container;

returning the collection container to an upright position; and in response, the fluid-valve resealing the fluid-communication opening.

14. An adapter cap for removal of fluid from a container comprising:

a housing defining at least one fluid-communication opening;

a member defines a biasing element in the form of a flexible annulus, said member movably mounted within said housing to close said fluid-communication opening in a first position under force from said biasing element and movable away from said fluid communication opening under influence of a force applied against said member and against a bias of said biasing element; and a fluid channel formed in one or both of said housing and said member, said fluid channel communicating between said fluid-communication opening and an interior of the container and being opened to fluid flow in a second position; and one or more air-release openings in said housing for allowing airflow into the container when fluid is withdrawn therefrom and wherein said one or more air-release openings are sealed via a valve.

15. The device of claim 14, wherein said one or more air-release openings are spaced from said fluid-communication opening so as to substantially prevent air becoming entrained in fluid being removed.

16. The apparatus of claim 14, wherein the valve comprises an umbrella valve at a recessed end of said one or more air-release openings.

17. The apparatus of claim 14, wherein said one or more air-release openings are surrounded by a tube that has a length that terminates between the midpoint and bottom of said container.

18. The apparatus of claim 14, further comprising said container, wherein said container is a collection container, wherein a base of said collection container contains said one or more air-release openings that are sealed via an umbrella valve seal.

19. The apparatus of claim 14, wherein said at least one fluid-communication opening protrudes from said housing.

20. The apparatus of claim 14, wherein said at least one fluid-communication opening is substantially funnel-shaped.

21. The apparatus of claim 14, wherein said at least one fluid-communication opening is adapted to receive an oral syringe.

22. The apparatus of claim 14, wherein said at least one fluid-communication opening is adapted to receive a luer syringe.

23. The apparatus of claim 14, wherein the housing defines a plurality of fluid communication openings.

24. The apparatus of claim 23, wherein at least one of the plurality of fluid-communication openings is adapted to receive an oral syringe, and wherein at least one of the plurality of fluid-communication openings is adapted to receive a luer syringe.

25. The apparatus of claim 14, wherein at least one fluid-communication cap is tethered to said housing.

26. The apparatus of claim 14, wherein at least one fluid-communication cap is attached to said housing via a living hinge.

27. The apparatus of claim 14, further comprising a sizing cap tethered to said housing.

28. A method using the adapter cap of claim 14, comprising:

mounting a bulk feed adapter cap on a collection container;

removing a fluid-communication cap;

inserting a needleless syringe into a fluid-communication opening;

inverting the collection container;

drawing on a plunger of the needleless syringe;

equalizing the internal pressure of the collection container; and replacing the fluid-communication cap on the fluid-communication opening.

29. A cap for a container, comprising:

a fluid communication opening defined in a cap housing, said fluid communication opening communicating with a container interior; and a membrane, wherein said membrane seals said fluid communication opening, said membrane having a plug portion which is surrounded by an annulus, wherein said annulus has a convex shape relative to a bottom surface of said cap housing, said annulus providing a spring-like region permitting movement of said plug portion away from said fluid communication opening under influence of a force applied against said plug portion and back toward said fluid communication opening when said force is removed, said plug portion closing said fluid communication opening in a first position and opening said fluid communication opening in a second position to permit fluid in said container interior to egress through said fluid communication opening.

30. The device of claim 29, further comprising:

an airflow opening defined in said cap housing, said airflow opening communicating with said container interior.

31. The device of claim 30, wherein said membrane seals said airflow opening.

32. The device of claim 31, wherein said membrane has a second plug portion which is surrounded by a second annulus, said second annulus providing a spring-like region permitting movement of said second plug portion away from said airflow opening under influence of a pressure change in said container interior and back toward said airflow opening when said pressure has equalized, said plug portion closing said airflow opening in a first position and opening said airflow opening in a second position to permit air to enter or leave said container interior.

33. The device of claim 29, wherein said membrane snap-fits into said cap housing.

34. The device of claim 29, wherein said plug has at least one raised member thereon in the form of a rib.

35. A cover for a container, comprising:

a material communication opening defined in a cover, said material communication opening communicating with a container interior; and a membrane, wherein said membrane seals said material communication opening, said membrane having a plug portion which is surrounded by an annulus, wherein said annulus has a convex shape relative to a bottom surface of said cover, said annulus providing a spring-like region permitting movement of said plug portion away from said material communication opening under influence of a force applied against said plug portion and back toward said material communication opening when said force is removed, said plug portion closing said material communication opening in a first position and opening said material communication opening in a second position to permit material in said container interior to egress through said material communication opening.

36. The device of claim 35, further comprising:

an airflow opening defined in said cover, said airflow opening communicating with said container interior.

37. The device of claim 36, wherein said membrane seals said airflow opening.

38. The device of claim 37, wherein said membrane has a second plug portion which is surrounded by a second annulus, said second annulus providing a spring-like region permitting movement of said second plug portion away from said airflow opening under influence of a pressure change in said container interior and back toward said airflow opening when said pressure has equalized, said plug portion closing said airflow opening in a first position and opening said airflow opening in a second position to permit air to enter or leave said container interior.

39. The device of claim 35, wherein said membrane snap-fits into said cover.

40. The device of claim 35, wherein said plug has at least one raised member thereon in the form of a rib.

41. A closure for a container, comprising:

a fluid communication opening defined in a closure, said fluid communication opening communicating with a container interior; and a flexible member, wherein said flexible member seals said fluid communication opening, said flexible member comprising a plug portion coupled to an annular collapsible member, wherein said annular collapsible member has a convex shape relative to a bottom surface of said closure, said collapsible member having a spring-like region permitting movement of said plug portion away from said fluid communication opening under influence of a force applied against said plug portion and back toward said fluid communication opening when said force is removed, said plug portion closing said fluid communication opening in a first position and opening said fluid communication opening in a second position to permit fluid in said container interior to egress through said fluid communication opening.

42. The device of claim 41, further comprising:

an airflow opening defined in said closure, said airflow opening communicating with said container interior.

43. The device of claim 42, wherein said flexible member seals said airflow opening.

44. The device of claim 43, wherein said flexible member has a second plug portion which is surrounded by a second annulus, said second annulus providing a spring-like region permitting movement of said second plug portion away from said airflow opening under influence of a pressure change in said container interior and back toward said airflow opening when said pressure has equalized, said plug portion closing said airflow opening in a first position and opening said airflow opening in a second position to permit air to enter or leave said container interior.

45. The device of claim 41, wherein said plug has at least one raised member thereon in the form of a rib.

46. A cap for a container, comprising:

a fluid communication opening defined in a cap housing having a top surface and a collar, said fluid communication opening configured to communicate with a container interior, said fluid communication opening protrudes from said top surface of said cap housing in a direction away from said collar and is adapted to receive a tip of a needleless syringe, wherein the top surface of the cap housing defines a recessed portion having a tubular sidewall that extends into and terminates in a region surrounded by said collar; and an airflow opening defined in a bottom surface of said recessed portion of said cap housing such that said airflow opening is recessed away from said top surface of said cap housing and into said container interior, wherein said fluid communication opening and said recessed airflow opening are each arranged off-center with respect to said top surface of said cap housing.

47. The device of claim 46, wherein said airflow opening is sealed by an umbrella valve.

48. The device of claim 46, wherein said fluid communication opening is spaced apart from said airflow opening along said top surface of said cap housing.

49. The device of claim 46, wherein said airflow opening is spaced from said fluid-communication opening so as to substantially prevent air becoming entrained in fluid being removed.

50. The device of claim 46, further comprising a valve in communication with said airflow opening, wherein said valve has a first position that seals said airflow opening and has a second position that opens said airflow opening permitting air to enter said container interior during removal of a fluid from said container interior.

51. A method using the cap of claim 46, comprising:

mounting an adapter cap on a collection container, wherein said adapter cap comprises a bulk feed adapter cap;

inserting a feeding syringe into a fluid-communication opening;

inverting said collection container;

drawing on a plunger of said feeding syringe; and equalizing an internal pressure of said collection container.

* * * * *